US008215795B2

(12) United States Patent
Pichel

(10) Patent No.: US 8,215,795 B2
(45) Date of Patent: Jul. 10, 2012

(54) UNDER-SHELF LIGHTING SYSTEM

(75) Inventor: Matthew Pichel, Engelwood, NJ (US)

(73) Assignee: POP Displays USA, LLC, Yonkers, NY (US)

( * ) Notice: Subject to any disclaimer, the term of this patent is extended or adjusted under 35 U.S.C. 154(b) by 297 days.

(21) Appl. No.: 12/621,152

(22) Filed: Nov. 18, 2009

(65) Prior Publication Data

US 2011/0044030 A1 Feb. 24, 2011

Related U.S. Application Data

(60) Provisional application No. 61/116,274, filed on Nov. 19, 2008.

(51) Int. Cl.
*F21S 4/00* (2006.01)
*F21V 21/00* (2006.01)

(52) U.S. Cl. ..... 362/249.02; 362/92; 362/125; 362/127; 362/133; 362/217.12; 362/217.16; 362/311.02; 362/800

(58) Field of Classification Search ..... 362/92, 362/125, 127, 132–133, 217.11–217.17, 362/225, 249.02, 311.02, 800
See application file for complete search history.

(56) References Cited

U.S. PATENT DOCUMENTS

| | | | | |
|---|---|---|---|---|
| 4,747,025 | A | 5/1988 | Barton | |
| 5,287,252 | A | 2/1994 | Caruso | |
| 5,690,415 | A | 11/1997 | Krehl | |
| 7,121,675 | B2 * | 10/2006 | Ter-Hovhannisian | 362/92 |
| 2006/0209537 | A1 | 9/2006 | Stelmasik | |
| 2008/0094824 | A1 * | 4/2008 | Stack et al. | 362/125 |

FOREIGN PATENT DOCUMENTS

| | | | |
|---|---|---|---|
| JP | 11-206530 | A | 8/1999 |
| JP | 2006-318789 | A | 11/2006 |
| JP | 2006320605 | A | 11/2006 |
| JP | 2009240382 | A | 10/2009 |

OTHER PUBLICATIONS

International Search Report and Written Opinion of the International Searching Authority for PCT/IB2011/052097 filed on May 12, 2011 which was mailed on Jan. 11, 2012. 8 pages.

* cited by examiner

*Primary Examiner* — Jason Moon Han
(74) *Attorney, Agent, or Firm* — Nolte, Nolte & Hunter

(57) ABSTRACT

A lighting assembly (9) for a standard in-store display shelf (2). The standard shelf is mounted on a standard in-store shelf bracket (4), having in-store header mounting hardware (6), which standard in-store display shelf (2) includes a conventional metal spring clip (10) for mounting a standard light fixture. The lighting assembly has a mount (11) for spring mounting to clip (10). The mount has rails (16-19), which form a pair of board channels (19A-B). A circuit board (20) slide mounts into the board channels. The circuit board serves as a mount for an array of Light Emitting Diodes (LEDs).

1 Claim, 3 Drawing Sheets

Detail A

Detail A

UNDER-SHELF LIGHTING SYSTEM

This utility patent application takes priority from Provisional Patent Application 61/116,274, filed Nov. 19, 2008.

The Present invention relates to an under-shelf lighting system.

DETAILED DESCRIPTION OF THE DRAWINGS

Figure 1:
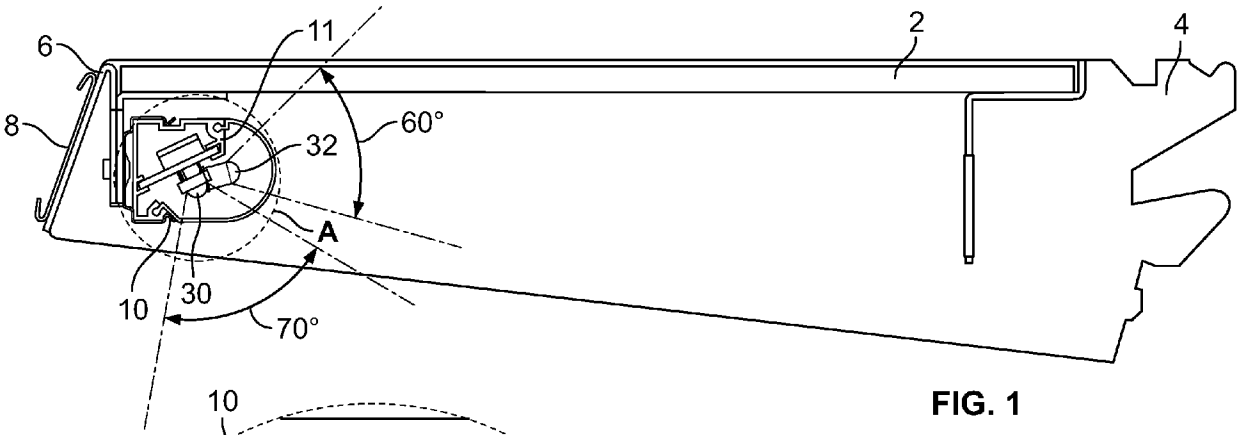
FIG. 1 is an elevation of a lighting system of the present invention mounted on standard display shelf hardware.

FIG. 1 shows a standard in-store display shelf 2, mounted on a standard in-store shelf bracket 4. Standard in-store header mounting hardware 6, comprises a product header label clip 8, and a conventional metal spring clip 10, shown in detail in FIG. 2, for mounting a standard florescent lighting fixture, not shown.

Instead, our lighting assembly, generally designated 9, of the present invention is clipped there, to clip 10.

The lighting assembly comprises a housing 11, which serves as a mount, to mount the assembly 9 to the spring clip 10. Mount 11 is the platform on which to mount the other elements of the lighting assembly. Mount 11 is preferably an aluminum extrusion of the shape shown in FIGS. 1 & 2.

Mount 11 comprises channels 13 & 14.

Rails 16-19 form channels 19A & 19B, into which is slidably mounted circuit board 20.

Clear extruded cover 21 has rails 22-23 which slidably mount it to mount 11's channels 13-14. Clear cover 21 protects the circuit board 20 within.

Cover 21 may in the alternative be frosted to act as a light diffuser.

As in all the figures, board 20 serves as a mount for standard LED lamps 30 having a 70 degree illumination angle (FIG. 1). In this embodiment, there are forty LEDs 30. These provide an ambient light for the display.

Figure 4:
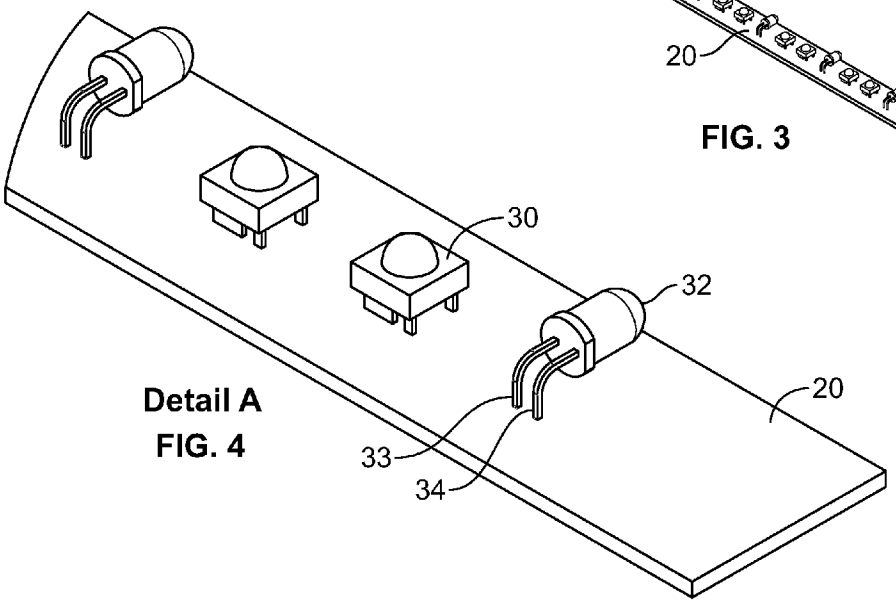
FIG. 4 is a detail of the area circled in FIG. 3.
Figure 5:
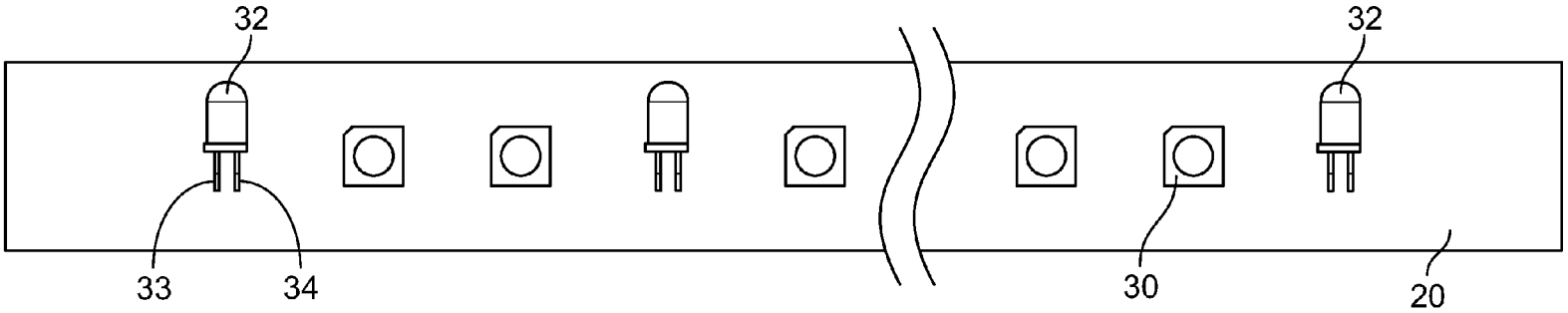
FIG. 5 is a top plan view of the array of FIG. 3, lying flat, with redundant center section omitted.
Figure 6:
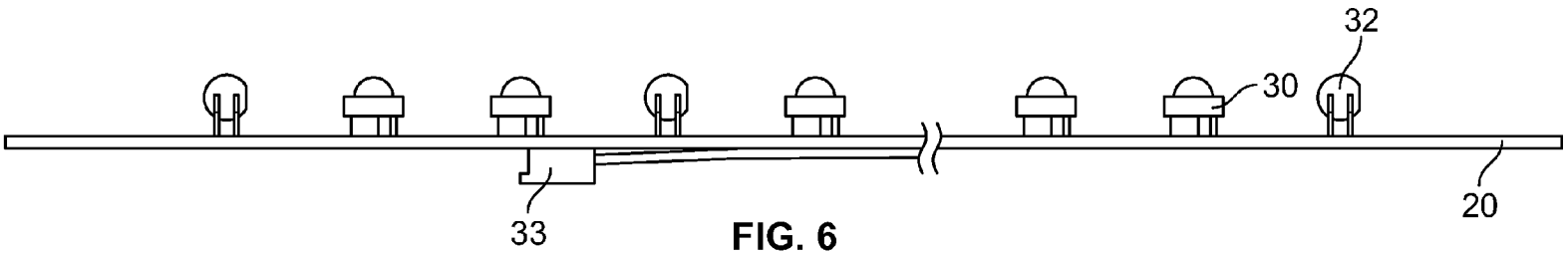
FIG. 6 is a front elevation of FIG. 5.

Board 20 serves as a mount for T-1¾ LED lamps 32, having a viewing angle that will be optimized for each of various assorted products and display dimensions. In this embodiment, there are twenty-one LEDs 32 having a 60° illumination angle. As in FIGS. 4-5, each LED lamp 32 is mounted on a pair of bendable wire leads 33-34. These provide a customizable light, in that the bendable leads 33-34 can be bent to angle each of the LEDs 32 to specifically aim LED 32 to best advantage the particular elements of a specific display.

Thus, a LED 32 can angle forward to back-light a translucent light box. Or LED 32 can angle rearward to front-light a background. Or LED 32 can angle directly towards the surface of a product or its package. Or LED 32 can angle the same as LEDs 30 to reinforce their illumination.

Figure 7:
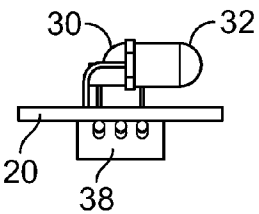
FIG. 7 is a an elevation of the right end of FIG. 6.

As in FIG. 7, board 20 serves as a mount for power supply connector 38, which transmits 12 Volt DC to the LEDs in parallel through circuit board 20.

FIG. 1 shows how these LEDs 30, 32 project below the display shelf 2, into display space there-below, above the shelf below, not shown.

Figure 2:
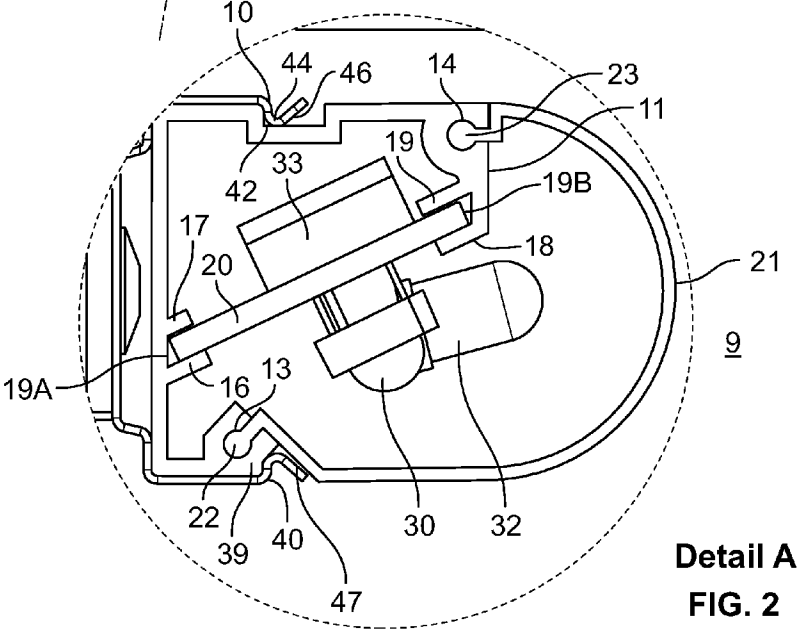
FIG. 2 is a detail of the area circled in FIG. 1.
Figure 3:
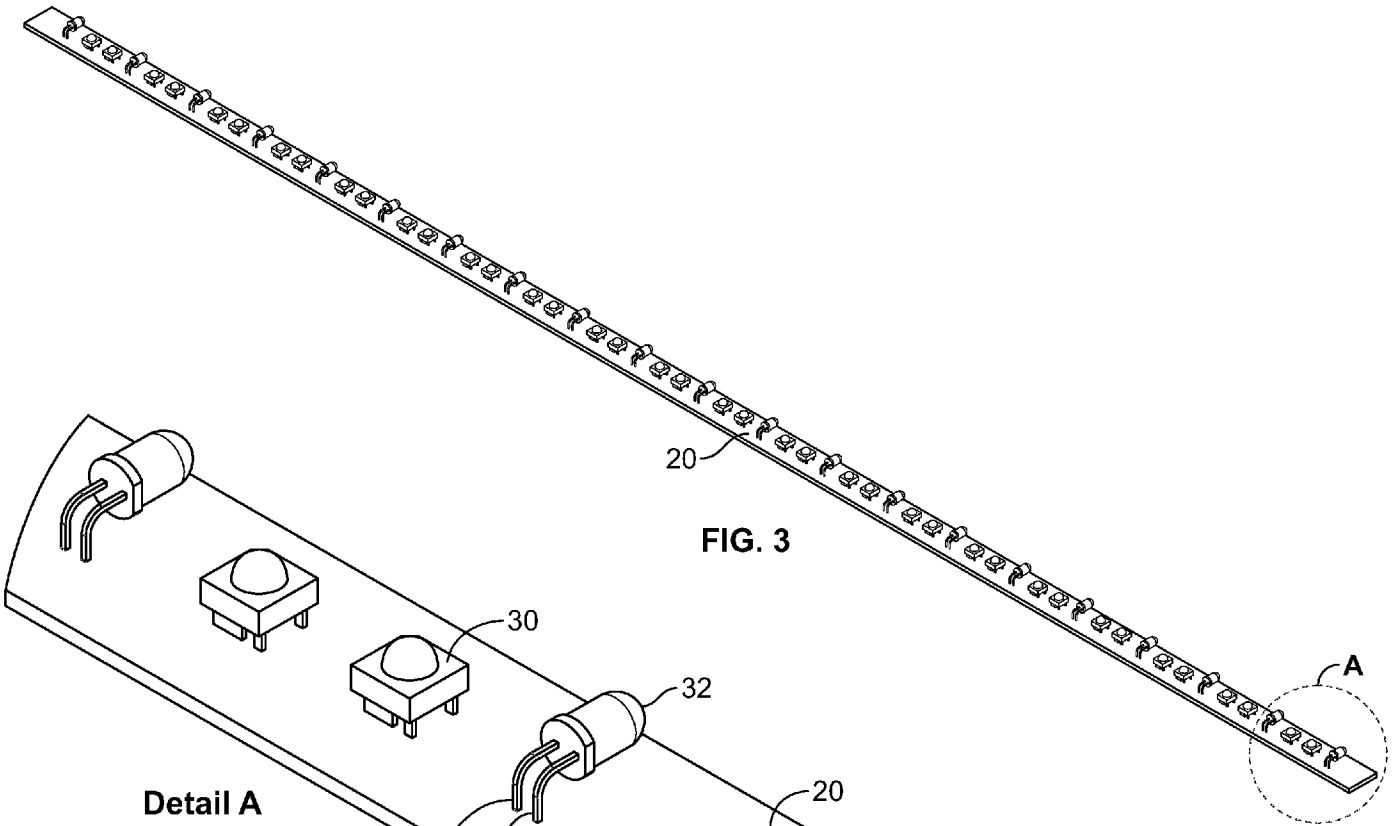
FIG. 3 is an oblique view of an array of LEDs shown in FIGS. 1 & 2.

FIG. 2 shows further details of aluminum mount 11. Ridge 39 forms a detent to engage bend 40 of spring clip 10. Detent 42 engages bend 44 of spring clip 10. Thus by inserting mount 11 against ramps 46-47 of spring clip 10, the mount 11 forces open spring clip 10 so that mount can be forced in until bend 40 snaps around ridge 39, and bend 44 drops into detent 42, both to secure mount 11 within the grasp of spring clip 10.

The invention claimed is:

1. A lighting assembly for a standard in-store display shelf, mounted on a standard in-store shelf bracket, having in-store header mounting hardware, which standard in-store display shelf includes a conventional metal spring clip for mounting a standard light fixture, the lighting assembly comprises:

a mount for spring mounting to the clip;

a plurality of rails, which form a pair of board channels into which is slidably mounted a circuit board;

said circuit board serves as a mount for a plurality of light emitting diodes (LEDs);

the mount further comprising:

a ridge, formed at one side of the mount, which ridge forms a first detent for engaging a bend of the spring clip;

a second detent, formed at an opposite side of the mount, said second detent for engaging a second bend of the spring clip;

forty of the plurality of LEDs are fixed LEDs, having a fixed angle mounting;

each fixed LED has a 70 degree illumination angle, for providing an ambient light for the display;

twenty-one of the plurality of LEDs are adjustable LED lamps;

each said adjustable LED lamp is mounted to the board on a pair of bendable conductors;

each said pair of bendable conductors is a means for bending its respective LED lamp to an angle selectively optimized for one of various directions;

each of the adjustable LED lamps is adjusted to have an illumination angle that is optimized for one of various display situations, from a group of various display situations consisting of:

highlight assorted products;

illuminate assorted display dimensions;

angle forward to back-light a translucent light box;

angle rearward to front-light a background;

angle directly towards the surface of a product or its package;

project light below the display shelf, into a display space there-below, above a shelf below; or angle the same as the fixed LEDs to reinforce illumination of the fixed LEDs;

the lighting assembly has a light-transmitting cover;

said mount comprises cover channels; and the light-transmitting cover has rails which slidably mount said light-transmitting cover to the cover channels, which protects the circuit board within.

* * * * *